US005655823A

United States Patent [19]

Schairbaum

[11] Patent Number: 5,655,823

[45] Date of Patent: Aug. 12, 1997

[54] ADJUSTABLE MONITOR SUPPORT ASSEMBLY

[75] Inventor: Edward C. Schairbaum, Ft. Worth, Tex.

[73] Assignee: Nova Solutions, Inc., Effingham, Ill.

[21] Appl. No.: 454,643

[22] Filed: May 31, 1995

[51] Int. Cl.[6] ..... A47B 17/00

[52] U.S. Cl. ..... 312/194; 312/223.3; 248/920; 248/286.1; 108/50; 108/5

[58] Field of Search ..... 312/194, 208.1, 312/223.3, 7.2; 108/102, 138, 5, 6, 7, 96, 50; 248/919, 920, 921, 922, 923, 286.1

[56] References Cited

U.S. PATENT DOCUMENTS

| | | | |
|---|---|---|---|
| 1,293,246 | 2/1919 | Thompson | 108/5 X |
| 2,194,889 | 3/1940 | De Lisle | 108/5 |
| 2,367,948 | 1/1945 | Kirsch | 108/90 |
| 2,704,235 | 3/1955 | Bion | 108/6 |
| 4,590,866 | 5/1986 | Schairbaum . | |
| 4,625,657 | 12/1986 | Little et al. | 108/5 X |
| 4,755,009 | 7/1988 | Price et al. . | |
| 5,071,204 | 12/1991 | Price et al. | 312/223.3 X |
| 5,087,010 | 2/1992 | Walters . | |
| 5,125,727 | 6/1992 | Lechman et al. | 312/194 |
| 5,377,951 | 1/1995 | Johnson et al. | 312/208.1 X |

FOREIGN PATENT DOCUMENTS

| | | | |
|---|---|---|---|
| 1106895 | 8/1981 | Canada . | |
| 518261 | 12/1992 | European Pat. Off. | 312/223.3 |

*Primary Examiner*—Peter M. Cuomo
*Assistant Examiner*—Janet M. Wilkens
*Attorney, Agent, or Firm*—Olson & Hierl, Ltd.

[57] ABSTRACT

An adjustable monitor support assembly is provided which incorporates a shelf member, side supports and slide plates between each side support and the shelf member. Elongated slots are provided in the side supports and in the slide plates with those in the slide plates being perpendicular to those in the side supports, and adjacent ones thereof are interconnected by a key. The front of the shelf member is pivotally connected to each slide plate. The shelf member is thus vertically and horizontally positionable and tiltably adjustable relative to the side supports, and the shelf member is spatially fixable by an adjustable clamp.

8 Claims, 2 Drawing Sheets

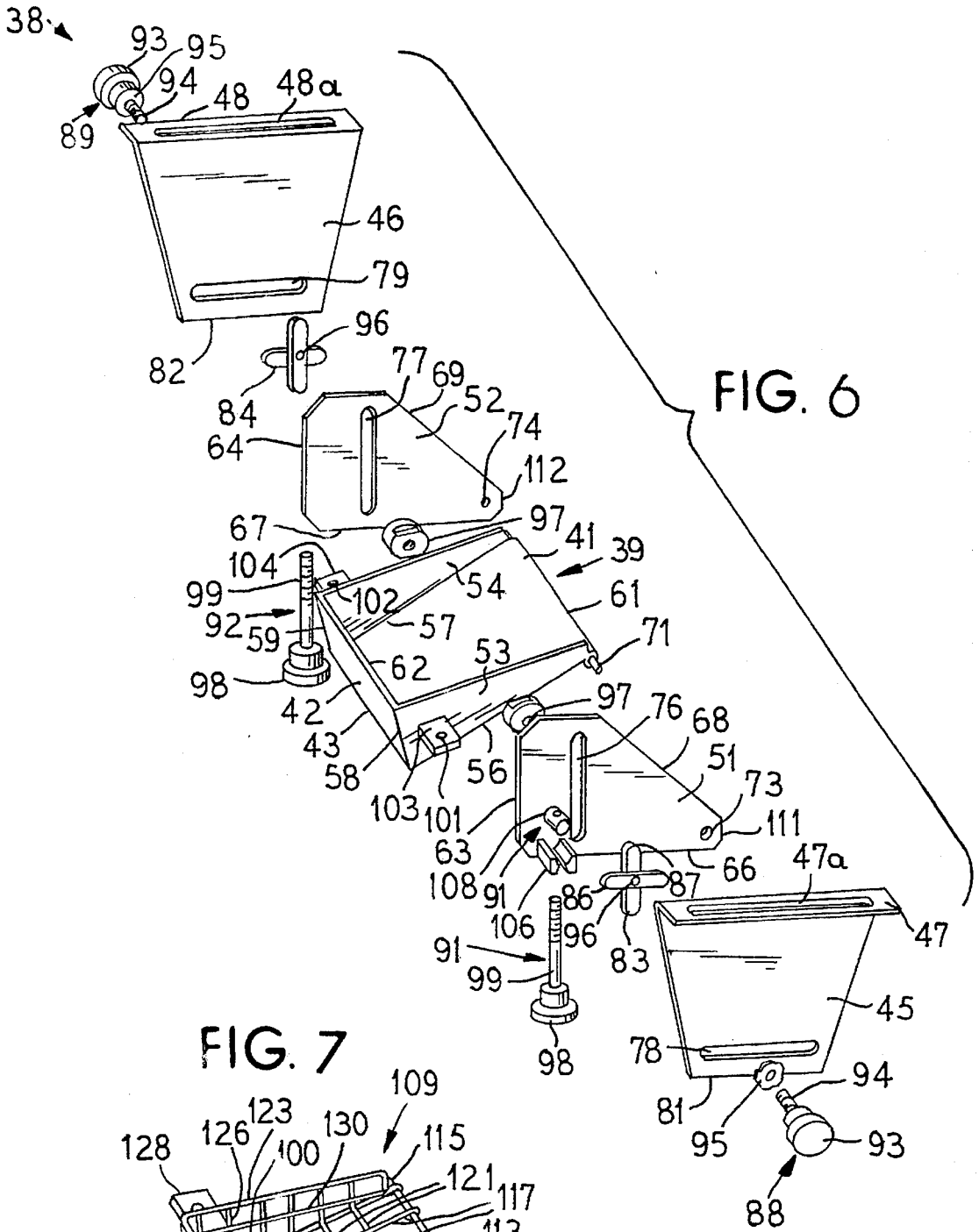
FIG. 6
FIG. 7
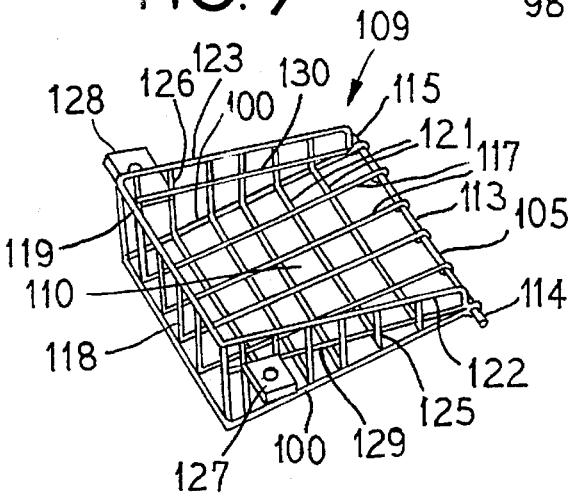

ADJUSTABLE MONITOR SUPPORT ASSEMBLY

FIELD OF THE INVENTION

This invention relates to underdesk monitor support assemblies for desk structures and the like that have a transparent top portion through which a monitor can be viewed.

BACKGROUND OF THE INVENTION

When a desk or similar structure is provided with a top member that incorporates a transparent surface portion, it becomes possible to position a cathode ray tube (CRT) monitor under the desk top surface for viewability through the transparent surface portion. Such arrangements are shown, for example, in Schairbaum U.S. Pat. No. 4,590,866 and Lechman et al. U.S. Pat. No. 5,125,727.

Such a monitor is in operative and functional association with a computer central processing unit (CPU) which can be in the desk structure or elsewhere as desired.

Because of the multiplicity of different desk structures and the like which can be equipped with a transparent top surface portion, there is a need in this new and developing art for a monitor support assembly that is adaptable for use in many different desk structures. A monitor support assembly should also be adjustable with regard to the tilt angle of a monitor supported thereby relative to the overlying transparent top surface portion of a desk structure so as to meet the needs of the individual use situation and the desires of the individual user.

There is a need in this art for an improved adjustable monitor support assembly which is adapted for use with a variety of desks and similar structures that are provided with a transparent surface portion. The assembly must also be adjustable to accommodate differing desired or needed spatial positions and orientations of a monitor supported therewith relative to the transparent surface portion. This invention provides such an assembly.

SUMMARY OF THE INVENTION

The present invention provides an adjustable assembly for supporting a monitor means or the like under a transparent surface portion of a desk or like structure.

The present invention also provides combinations of such a desk or like structure with such an adjustable monitor support assembly.

In an embodiment of the adjustable monitor support assembly of this invention, a shelf member having a bottom support member and a upstanding back member is utilized. Preferably, a side wall is provided along opposed lateral sides of the bottom and back members. It is preferred that the bottom support member, the back member and the side walls (if present) are each generally flat, extend perpendicularly to each other, and are integral with one another along the adjoining edge portions.

The shelf member is supported relative to a desk or like structure by means of a pair of side supports and a pair of slide plates. One of each of the side supports is located along a different lateral side of the shelf member. These side supports preferably each have generally flat opposed side portions that are vertically oriented and in opposed relationship to each other. Each side support is preferably suspended from the underside of a top portion of a desk structure so that interconnection with kneehole side walls or the like can be avoided, if desired, and so that the monitor support assembly can be used with many different desks or like structures.

However, if desired, each side support can be associated by an alternative means or any convenient arrangement with a desk or like structure. For example, the side supports can each be directly mounted in spaced, adjacent relationship to the sidewall on each opposed side of a kneehole. Thus, the support assembly of the present invention can be used in a desk or work station having virtually any size of kneehole, or even in a table which does not define a kneehole. It also allows for retrofitting thereof with an existing desk structure.

To provide vertical and horizontal positionability and tilt adjustability for the shelf member, each slide plate is generally flat and is located between a different one of each side support and its adjacent lateral side of the shelf member. A forward location of each slide plate is pivotally associated with an adjacent opposed frontal location along each lateral side of the shelf member yet leaving the shelf member translatable with the slide plates.

A first pair of opposed elongated slots is defined, each one in a different side support; and a second pair of opposed elongated slots is defined, each one in a different slide plate. The first slot pair extends in a generally different direction and preferably perpendicularly relative to the second slot pair. The slot pairs are adapted to be cooperative with one another. A suitably shaped key member is positioned to ride slidably in and between slots of each one of an adjacent pair comprising one member of each of the first and second slot pairs located on each lateral side of the shelf member.

In this manner, the slide plate on each shelf member side is translatable horizontally and/or vertically relative to the side supports along a pathway determined by the transient crossover location existing between respective adjacent members of the first and the second slide pairs for any given opposed configuration of the slide plates relative to the side supports.

Adjustable nut and bolt assemblies are employed and arranged so that the shelf member position and tilt angle are adjustable and fixable relative to the side supports.

The shelf member, the side supports and the slide plates can each be formed of any convenient material, such as formed sheet metal, interwelded heavy wire components, fiber reinforced plastic sheeting or the like.

The present adjustable monitor assembly is believed to offer a substantial advance in the art of underdesk monitor supports and to overcome various problems and limitations particularly associated with certain prior art underdesk monitor mounting assemblies.

Other and further objects, aims, purposes, features, advantages, and the like will be apparent to those skilled in the art from the present specification taken with the accompanying drawings.

BRIEF DESCRIPTION OF THE DRAWINGS

In the accompanying drawings, which comprise a portion of this disclosure:

FIG. 6 is an exploded perspective view of the monitor support assembly of FIG. 1; and FIG. 7 is a perspective view of an alternative embodiment of a shelf member adapted for use in the monitor support assembly of FIGS. 1–6.

DETAILED DESCRIPTION

Figure 1:
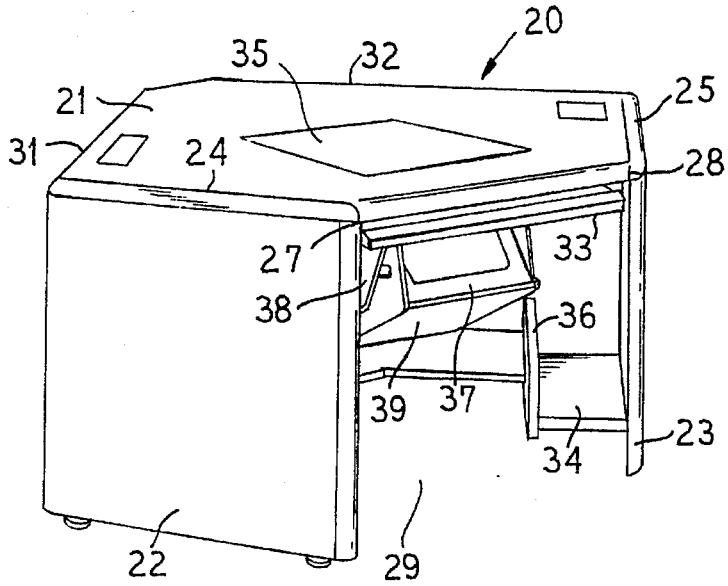
FIG. 1 is a perspective view of one embodiment of a monitor support assembly of the present invention mounted under one type of associated desk structure.
Figure 3:
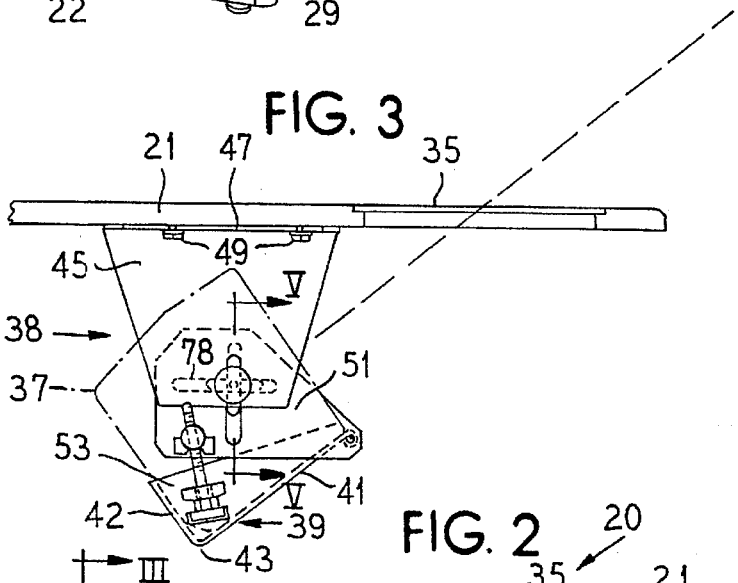
FIG. 3 is a vertical sectional view taken along the line III—III of FIG. 2.
Figure 2:
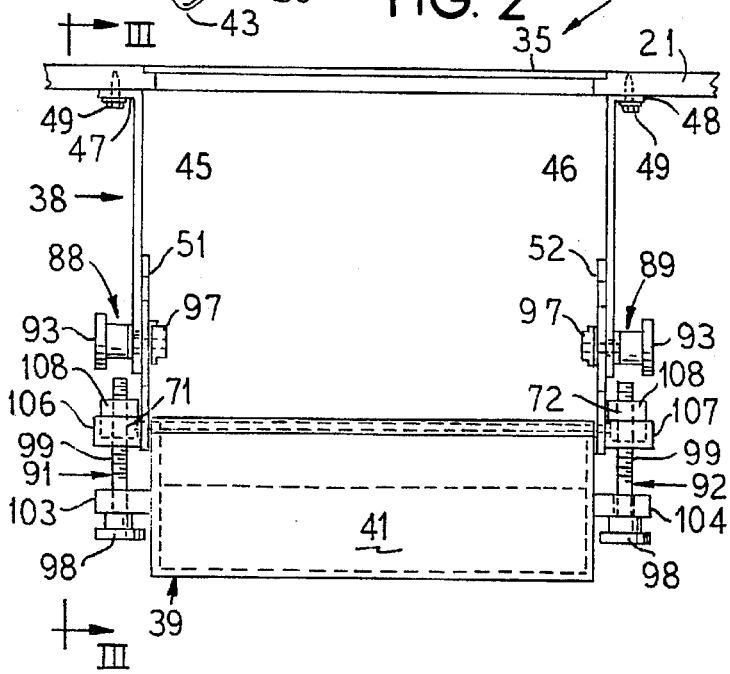
FIG. 2 is a fragmentary front elevational view showing the monitor support assembly and the desk structure of FIG. 1.

Referring to the drawings, there is seen in FIGS. 1 through 3 an illustrative embodiment of a desk structure 20 that is functionally associated with a monitor support assembly 38 of the present invention. The desk shown in the drawing is suitable for positioning at the corner of a work station or in the corner of a room. However, any shape or size of desk can be used.

Desk structure 20 has a top flat surface member 21 that is supported by peripheral wall members including the side wall members 22 and 23 which extend perpendicularly relative to each other backwards along sides 24 and 25 from each respective front corner 27 and 28 of kneehole 29. The side wall members 22 and 23 adjoin back wall members (not detailed) that extend downwards from the back edges 31 and 32 of surface member 21.

Under the surface member 21 across the kneehole 29 is slidably mounted a transversely short keyboard holding platform 33 that is transversely slidable from the closed position shown in FIG. 1 to a fully outwardly extended position. While any convenient structure can be used for platform 33 and its slidable mounting means, the structure shown in copending U.S. patent application Ser. No. 774,416 filed Oct. 10, 1991 now U.S. Pat. No. 5,205,631 issued Apr. 27, 1993 is now preferred (the disclosure of which is incorporated herein by reference).

A CPU (not shown) can be housed, if desired, under surface member 21 on a shelf 34 which is supported on one side thereof by, and which inwardly extends from, wall member 23. The opposed side of shelf 34 is supported by an inside wall 36 that is itself held by a back wall and surface member 21.

A monitor 37 (see FIG. 1), for example is positioned in an upper rear portion of the kneehole 29 from where its screen is visible through a transparent portion, such as a rectangular or square piece of glass 35, that is inset centrally in an aperture defined in surface member 21. The monitor 37 is supported by the monitor support assembly 38. The monitor 37 and a keyboard (not shown) on holding platform 33 are each functionally interconnected by cables (not shown) or the like with a CPU, to provide a complete word-processing work station, or the like, as desired, within the desk structure 20.

Support assembly embodiment 38 utilizes a shelf member 39 having a flattened bottom member 41 and a flattened back member 42 that preferably integrally upstands or extends preferably perpendicularly from a rear edge of bottom member 41. Shelf member 39 can also be provided with a pair of flattened side walls 53 and 54. Each side wall 53 and 54 is located along a different opposed side edge 56 and 57 of bottom member 41 and each extends upwardly along the opposed side edges 58 and 59 of back member 42. These side walls 53 and 54 are preferably flattened, preferably in spaced, parallel relationship to each other, and preferably vertically oriented relative to each of the bottom member 41 and the back member 42. The side walls 53 and 54 are preferably integrally associated with the bottom member 41 and the back member 42. Preferably, the side walls 53 and 54 are tapered or diagonally extend along their upper edge from the upper edge 62 of back member 42 forwardly towards the front edge 61 of bottom member 41 (see, for example, FIG. 6).

Shelf member 39 can be comprised of various materials, but in embodiment 38 is shown as being comprised of sheet metal. Any convenient fabrication procedure can be used. For example, the bottom member 41 and the back member 42 can be derived from a single sheet of sheet metal that is bent to form edge 43. The shelf side walls 53 and 54 can be separately formed and can be welded or the like to side edges 56 and 57, and 58 and 59.

Optionally, the sheet metal can be expanded or perforated (not shown) to enhance air circulation therethrough and cooling capacity for a monitor 37 that rests thereon.

In place of sheet metal, any suitable relatively thin and rigid construction material can be used, such as, for example, interwelded wire members, fiber reinforced thermoset plastic sheets, rigid resin impregnated sheet like structures (wherein the sheet-like structure is, for example, a preformed nonwoven material comprised of cellulosic paper or a preformed woven material comprised of a synthetic fiber) or the like. The shelf member 39 can be overcoated by dipping, painting or the like with a paint or an elastomeric material which is also electrically insulative, if desired.

Support assembly 38 also incorporates a pair (preferably left and right mirror images of each other) of side supports 45 and 46. Each is flattened, oriented vertically, and disposed along a different opposed lateral end edge of shelf member 39. In the embodiment shown, each one of the side supports 45 and 46 is preferably formed of sheet metal, but alternatively can be formed of materials such as indicated above for the shelf member 39. Conveniently, each side support 45 and 46 is rectangularly or trapezoidally (preferred) configured. Preferably, each side support is provided with an outturned respective upper tab 47 and 48 (preferred) for optional but preferred usage in mounting the associated side support 45 and 46 from the underside of surface member 21, if desired. For example, and as shown in FIGS. 2 and 3, each side support is supported by tabs 47 and 48 from surface member 21 by means of a plurality of hex-headed screws 49 or the like. Elongated slots **47*a* and 48*a* found in the tabs 47 and 48 permit longitudinal adjustment of the side supports 45 and 46. Any convenient means can be employed for mounting side supports 45 and 46 to a desk, such as desk structure 20** or the like.

Support assembly 38 further incorporates a pair (preferably left and right mirror images of each other) of slide plates 51 and 52. Each is flattened, oriented vertically, and located between (a) a different adjacent one of the side supports 45 and 46, respectively, and (b) an adjacent one of the opposed lateral side walls 53 and 54, respectively, of the shelf member 39. Also, each is vertically extended in its rearward region and has a rear edge 63 and 64 which preferably extends generally perpendicularly relative to a bottom edge 66 and 67 respectively from a position that is in forwardly spaced relationship to the upper end of each rear edge 63 and 64. The upper edge 68 and 69 of each slide plate 51 and 52 preferably tapers or extends diagonally forwardly to a location adjacent the forward end 111 and 112 of each bottom edge 66 and 67, respectively. Each of the slide plates 51 and 52 is preferably formed of sheet metal, but alternatively can be formed of materials such as indicated above for the shelf members 39.

At the forward end of each side edge 56 and 57 of bottom member 41 of shelf member 39, a pair of oppositely outwardly extending support shafts or rods 71 and 72 is provided. Preferably, each shaft 71 and 72 is comprised of steel and is welded or the like at the inner end thereof to adjacent surface portions of the bottom face of bottom member 41. Alternatively, each shaft 71 and 72 can comprise respective opposite ends of a single rod which is extended through the forward end of shelf member 39. A hole 73 and 4 through which respective shafts 71 and 72 can be slidably received is provided through the forward end portion of each slide plate 51 and 52. After each shaft 71 and 72 is extended through the respective hole 73 and 74, its end may be provided with a snap ring, cotter pin, threaded nut or like conventional retaining means (not detailed). Thus, a forward location of each slide plate 51 and 52 is pivotally associated with an adjacent frontal location of shelf member 39 along each lateral side thereof. Any convenient means can be used to pivotally associate the slide plates with the shelf member.

A first pair of laterally aligned, elongated slots 76 and 77 is defined one in each slide plates 51 and 52. In support assembly 38 (as shown), each slot 76 and 77 is straight and vertically extends in the rearward vertically extended region of each slide plate 51 and 52 in forwardly spaced relationship to the adjacent rear edge 63 and 64 thereof.

A second pair of laterally aligned, elongated slots 78 and 79 is defined, one in each side support 45 and 46. In support assembly 38 (as shown), each slot 78 and 79 is straight and horizontally extends in a lower or bottom region of each side support 45 and 46 in vertically spaced relationship to the adjacent bottom edge 81 and 82 of each side support 45 and 46.

Alternative orientations for such slot pairs can be used, if desired. Both members of the slot pair in slide plates 51 and 52 should extend preferably perpendicularly to the slot pair in side supports 45 and 46 at locations of alignment (i.e., so called cross-over locations) laterally therebetween.

Figure 4:
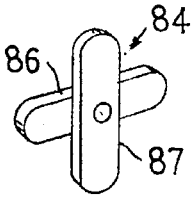
FIG. 4 is a greatly enlarged perspective view of one embodiment of a key member used between adjacent slide plate and side support combinations in the monitor support assembly of FIG. 1.
Figure 5:
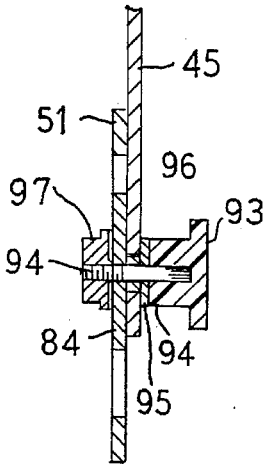
FIG. 5 is a fragmentary enlarged vertical sectional view taken through the region V—V of FIG. 3.

A pair of slide keys 83 and 84 is provided whose members are formed of metal, or preferably a self-lubricating plastic, such as a waxy plastic, a high density polypropylene, or the like. The slide keys 83 and 84 are preferably integrally formed of one-piece construction, and preferably each is identical to the other. As shown in representative FIG. 4, in support assembly 38, one side 86 of each key 83 or 84 is elongated and the elongation is configured to slidably engage one slot, such as a slot 78 or a 79.

Similarly, the opposed side 87 of each key 83 or 84 is elongated in a direction that is perpendicular relative to the elongation direction in side 86, and this elongation likewise is configured to slidably engage an opposed adjacent slot, such as a slot 76 or 77. In the assembled support assembly 38, one key 83 and 84 is positioned between each adjacent pair of side support and slide plate 45/51 and 46/52 with each opposed side of one key 83 and 84 being slidably engaged with a different one of the slots 76/78 and 77/79.

Thus, vertical movements of the slide plates 51 and 52 relative to side supports 45 and 46 take place along the vertical slots 76 and 77, and horizontal movements of the slide plates 51 and 52 relative to the side supports 45 and 46 take place along the horizontal slots 78 and 79.

Pivotal movements of shafts 71 and 72 in holes 73 and 74 adjust the tilt angle of the surfaces of bottom member 41 and of back member 42 selectively relative to the slide plates 51 and 52. Thus, the position and orientation of a monitor, such as monitor 37, which is resting and retained upon bottom member 41 and back member 42 preferably by gravity, are adjustable.

The shelf member 39 is adjustable to a desired spatial orientation relative to the side supports 45 and 46 with the use of holding means which can have various structures and forms as those skilled in the art will readily appreciate. A present preference is to employ in association with support assembly 38 both a pair of adjustable nut and bolt clamps 88 and 89 for holding each of the slide plates 51 and 52 relative to the side supports 45 and 46, and also a pair of nut and bolt assemblies 91 and 92 for holding the shelf member 39 relative to the slide plates 51 and 52.

Each clamp 88 and 89 is identical to the other thereof and each here employs a bolt structure whose enlarged head 93 is preferably circumferentially graspable by the thumb and forefinger of a hand (not shown) and whose relatively short shank 94 extends perpendicularly through a central bore 96 that is provided in each slide key 83 and 84. Each clamp 88 and 89 also includes an enlarged nut 97 that is threadably engagable with the shank 94 and is likewise preferably circumferentially graspable by the thumb and forefinger. Peripheral radial portions of the head 93 and of the nut 97 are adapted to be frictionally engagable with adjacent surface portions of the side supports 45 and 46 and of the slide plates 51 and 52 when each clamp 88 and 89 is tightened, thereby to clamp together adjacent respective surfaces of side support and slide plate member combinations 45/51 and 46/52.

Thus, these member combinations are held together on each side of the shelf member 39 in a desired fixed but adjustable relationship. Optionally but preferably, a spring washer 95 is fitted around each shank 94 so as to be adjacent head 93 thereby to provide yielding bias holding the member combinations in engaged relationship. In place of spring washer, one can employ a Belleville washer or the like, if desired.

Each nut and bolt assembly 91 and 92 is identical to the other thereof and each here employs a bolt structure whose enlarged head 98 is likewise preferably circumferentially graspable by a thumb and forefinger and whose shank 99 is elongated. The shank 99 is loosely extended through a hole 101 and 102 in each respective one of a pair of laterally outwardly projecting shelf adjustment brackets 103 and 104, each bracket being opposed to the other thereof and located adjacent a rearward portion of shelf member 39. Conveniently, each bracket 103 and 104 is comprised of metal and is mounted to side wall 53 and 54 respectively by welding or the like. The head 98 is adapted to abut against each bracket 103 and 104. The forward end of each shank 99 extends upwardly through a positioning bracket 106 and 107 that is preferably comprised of metal and that laterally outwardly projects from a rearward portion of each slide plate 51 and 52. Each bracket 106 and 107 is here shown to be of the forked type that has a diametrically located, longitudinally extending (relative to such a bracket) slotted aperture therein and each bracket 106 and 107 is conveniently butt-welded or the like to its associated plate 51 and 52. Each slotted aperture preferably has beveled sides and an open outer end for ease in engaging same with a shank 99. Each bracket 106 and 107 is located in vertically spaced aligned relationship with a different one of the holes 101 and 102 in brackets 103 and 104, respectively.

A circumferentially rounded nut 108 is provided for each shank 99 which nuts 108 rests upon and is preferably loosely journaled by the upper surface portions of each bracket 106 and 107. The nut 108 is threadably engagable with the shank 99. The nut 108 is likewise preferably circumferentially graspable by a thumb and a forefinger. By adjusting the position of nut 108 along shank 99 with the nut 108 resting against the respective bracket 106 and 107, the effective length of the shank 99 between vertical bracket pairs 103/

106 and 104/107 is controllably varied. This effective length of the shank 99 thus controls the tilt angle of shelf member 39 about an axis that extends laterally between the shafts 71 and 72. Thus, the tilt angle of shelf member 39 is adjustable and fixable.

An alternative but presently preferred embodiment 109 for the shelf member 39 is shown in FIG. 7. Shelf member 109 is comprised of heavy wire members which are interwelded together at locations of contact therebetween. Thus, shelf member 109 incorporates a bottom perimeter member wire 100 which defines the opposing sides and back of the bottom member 110. The opposite ends of wire 100 are circumferentially bent around and welded to an end wire 105 which laterally extends across the front 113 of the bottom member (and shelf member 109) and which has opposite ends that laterally outwardly extend to define an opposed pair of shafts or struts 114 and 115 for shelf member 109 support and pivotal movements.

A plurality of support wires 117 extend back from end support wire 105 in spaced, parallel relationship to one another, and, at the back of the bottom member 110, are each bent upwards at a 90° angle; thereby to define a back wall 118. The upper end of back wall 118 is terminated by a horizontally extending wire 119 which is welded to abutting terminal ends of the individual wires 117 and whose opposite ends are bent downwards at 90° and are joined by welding to wire 100 each respective corner of the bottom member 110. A plurality of transversely spaced, parallel wires 121 extend laterally across the bottom member 110 and perpendicularly across and under the wires 117 to which they are welded at crossover pivots. Terminal portions of each wire 121 at respective opposite ends thereof are bent upwards at 90° to define the respective spaced, parallel side walls 125 and 126 of shelf member 109. From the back upper opposed corners of the back wall 118, a framing wire 122 and 123 extends forwardly toward wire 105 to which the forward end of each wire 122 and 123 is welded after a terminal downturn. Wires 122 and 123 at their opposite ends are welded to the wire 119. The brackets 127 and 128 can be welded to individual wires such as wires 129 and 130 that extend in parallel relationship to respective wires 122 and 123, and brackets 127 and 128 can be the same as brackets 103 and 104 in shelf member 39.

Various other and further embodiments, applications, structures and the like will be apparent to those skilled in the art from the teachings herein provided and no undue limitations are to be drawn therefrom.

What is claimed is:

1. An adjustable monitor support assembly comprising:

(a) a shelf member comprised of interwelded wire members;

(b) a pair of side support means, each one being on a different side of said shelf member, and including side support mounting means;

(c) a pair of slide plate means, each one being between a different said side support means and its adjacent said shelf member side;

(d) elongated first slot means defined in said side support means and elongated second slot means perpendicularly oriented relative to said first slot means in said slide plate means;

(e) key means between each said side support means and its adjacent said slide plate means and configured to slidably extend in adjacent ones of said first and said second slot means for orienting said slide plate means relative to said side support means;

(f) pivot means associating a frontal portion of each slide plate means with an opposed front side portion of said shelf member;

(g) adjustable holding means for fixing each said slide plate means and its adjacent said side support means so that said shelf meter is horizontally and vertically positionable; and (h) adjustable means for fixing each said slide plate means to said shelf member so that said shelf member is adjustably tiltable relative to said side support means and also for fixing the tilt angle of said shelf member relative to said slide plate means.

2. An adjustable monitor support assembly for supporting monitor means under a transparent window portion of the top member of a desk comprising in combination:

(a) a shelf member having a bottom member with an integral back member and integral side members and including:

(i) a pair of outwardly laterally projecting shelf support shaft means, each one being opposed to the other and located adjacent a forward frontal portion of said shelf member; and (ii) a pair of outwardly laterally projecting shelf adjustment bracket means, each one being opposed to the other and located adjacent a rearward portion of said shelf member;

(b) a pair of side support means, each one oriented vertically and having a flattened side face that is disposed in spaced, parallel, opposed relationship relative to the other thereof along a different opposed lateral side edge of said shelf member, and each one including:

(i) fastening means for mounting same to said desk or like structure; and (ii) elongated first slot means defined in said side face thereof;

(c) a pair of flattened slide plate means, each one oriented vertically and located between a different one of said side support means and its adjacent said lateral side edge, and each one including:

(i) associating means located adjacent a forward frontal portion for pivotally engaging said one slide plate means with a different one of said support shaft means;

(ii) elongated second slot means defined therein and extending generally normally to said first slot means; and (iii) a pair of positioning bracket means, each one laterally projecting from a rearward portion thereof and being located generally in vertically spaced relationship to a different adjacent one of said adjustment bracket means;

(d) a pair of key means, each one being positioned between one said side support means and its adjacent said slide plate means and each one including on opposite sides thereof a lateral projection, each said projection being slidably engaged with a different adjacent one of said first and said second slot means so that said shelf member is horizontally and vertically positionable and vertically tiltably relative to said side support means;

(e) a pair of adjustable clamping means, each one holding a different one of said slide plate means in a desired fixed relationship relative to its adjacent said side support means; and (f) a pair of nut and bolt means, each one having a bolt with an elongated shank, each one being positionable between a different one of said bracket means and its adjacent spaced positioning bracket means so that the tilt angle of said shelf member is adjustably fixed.

3. The support assembly of claim 2 wherein said shelf member is comprised of sheet metal.

4. The support assembly of claim 2 wherein said shelf member is comprised of interwelded wire members.

5. The support assembly of claim 2 wherein said side support means and said slide plate means are each comprise of sheet metal.

6. The support assembly of claim 2 wherein said first slot means extends horizontally and said second slot means extends vertically.

7. The support assembly of claim 2 which is mounted within, and is thus in combination with a desk structure that includes a work platform having a transparent portion.

8. A combination of a desk structure and an adjustable monitor support assembly, said combination comprising:

(A) said desk structure comprising:

(a) a work platform having a transparent surface portion, and (b) work platform support means for supporting said work platform in upwardly spaced relationship relative to a floor, and (B) said adjustable monitor support assembly comprising:

(a) a shelf member beneath said work platform and positioned for viewability through said transparent surface portion;

(b) a pair of side support means, each one being on a different side of said shelf member, and including side support mounting means for associating said monitor support assembly with said desk structure;

(c) a pair of slide plate means, each one being between a different said side support means and its adjacent said shelf member side;

(d) elongated first slot means defined in said side support means and elongated second slot means perpendicularly oriented relative to said first slot means in said slide plate means;

(e) key means between each said side support means and its adjacent said slide plate means and configured to slidably extend in adjacent ones of said first and said second slot means for orienting said slide plate means relative to said side support means;

(f) pivot means associating a frontal portion of each slide plate means with an opposed front side portion of said shelf member;

(g) adjustable holding means for fixing each said slide plate means and its adjacent said side support means so that said shelf member is horizontally and vertically positionable; and (h) adjustable means for fixing each said slide plate means to said shelf member so that said shelf member is adjustably tiltable relative to said side support means and also for fixing the tilt angle of said shelf member relative to said slide plate means.

* * * * *